United States Patent [19]

Heitzman

[11] 4,367,640

[45] Jan. 11, 1983

[54] APPARATUS FOR FORMING SHEET METAL DUCT WORK

[76] Inventor: Steven C. Heitzman, 2664 NW. Thurman St., Portland, Oreg. 97210

[21] Appl. No.: 273,633

[22] Filed: Jun. 15, 1981

Related U.S. Application Data

[63] Continuation of Ser. No. 115,726, Jan. 28, 1980, abandoned.

[51] Int. Cl.[3] ..... B21D 5/14

[52] U.S. Cl. ..... 72/11; 72/170; 72/173

[58] Field of Search ..... 72/9, 11, 12, 21, 166, 72/170, 173; 113/116 UT

[56] References Cited

U.S. PATENT DOCUMENTS

| | | | |
|---|---|---|---|
| 2,995,171 | 8/1961 | Häusler | 72/15 |
| 3,906,765 | 9/1975 | Foster | 72/9 |
| 4,031,733 | 6/1977 | Coody | 72/166 |
| 4,080,815 | 3/1978 | Foster | 72/173 |
| 4,142,394 | 3/1979 | Damman | 72/220 |
| 4,232,540 | 11/1980 | Cain et al. | 72/11 |

*Primary Examiner*—Francis S. Husar
*Assistant Examiner*—Jonathan L. Scherer
*Attorney, Agent, or Firm*—Eugene D. Farley

[57] ABSTRACT

Apparatus is provided for forming sheet metal ducts of varying conical configuration from pre-cut blanks having a baseline and element lines thereon. The apparatus comprises a frame supporting independent axially aligned feed rolls. Each roll is power driven by separate variable-speed motors providing for a different feed rate at each edge of the blank being formed. The driven sections of each feed roll are adjacent at the center of the axially aligned rolls. Idler rolls around the drive shaft form the remaining length of each roll. Corresponding segmented pinch rolls spaced axially at the center are arranged to pinch the blank to be formed against the feed rolls. Sensors are positioned between the spaced ends of the pinch rolls to detect the position of the blank baseline and the angularity of the element lines. The feed and pinch rolls are mounted on bases provided with bearings permitting axial shifting to maintain the blank baseline at the established position relative to the frame.

A bending roll is spaced from the feed roll and adapted to have its axis positioned at an angle to the feed roll to produce a different radius of curvature at each edge of the blank as forming progresses.

10 Claims, 10 Drawing Figures

APPARATUS FOR FORMING SHEET METAL DUCT WORK

This application is a continuation of application Ser. No. 06/115,726, filed Jan. 28, 1980, now abandoned.

BACKGROUND AND GENERAL STATEMENT OF THE INVENTION

My invention pertains to apparatus for forming sheet metal ducts of variable configurations from pre-cut flat blanks.

Sheet metal fabrication requires the forming of ducts of a general conical configuration ranging from symmetrical cones to offset cones. In sheet metal shops this is performed by cutting a flat blank from the material to be formed by marking the material with a multiplicity of element lines of varying lengths which establishes the shape of the blank to be formed into the sheet metal duct.

Using conventional forming rolls of either the pinch or pyramid type the blank is fed through the rolls maintaining the element lines parallel to the feed rolls by continuous manual adjustment of the blank position. The axis of the bending roll is adjusted to a varying angle relative to the feed rolls to provide bending at the proper radius at the ends of each of the successive element lines.

Equipment is not available that will automatically maintain the element lines parallel to the feed rolls and simultaneously maintain adjustment of the bending roll axis relative to the feed rolls to form the blank into the desired duct. It is the general object of the present invention to provide apparatus for forming variable sheet metal configurations from a prepared blank without the necessity of continuous manual manipulation.

Another object of the invention is to provide apparatus that will automatically maintain the element lines parallel to the feed rolls as the successive element lines enter the feed rolls.

Another object of the invention is to provide apparatus that will automatically maintain adjustment of the bending roll relative to the feed rolls as the successive element lines come in contact with the feed rolls.

Another object of the invention is to provide apparatus that can be pre-programmed to form the prepared blank to the desired duct configuration.

Another object of the invention is to provide apparatus that will repeatedly process successive identical blanks to the desired configuration.

Another object of the invention is to provide apparatus that is capable of forming continuously variable conical sections.

Another object of the invention is to provide apparatus that will function without the need for continuous operator manipulation.

Another object of the invention is to provide apparatus that is adaptable to various thicknesses of blank material.

Broadly considered the foregoing and other objects of this invention are accomplished by apparatus which comprises power-driven feed rolls and pinch rolls adapted to pinch the material being formed into contact with the drive rolls. A bending roll is spaced from the drive rolls and pinch rolls with its axis parallel to the pinch rolls in one plane and adapted to have its axis positioned at an angle to the axis of the inch rolls in a plane 90° to the first plane. The drive and pinch rolls are mounted on a frame in a manner providing for being shifted longitudinally relative to the length of the frame and bending roll. Sensing elements are positioned on the axis of the pinch roll to detect the position of the baseline and element lines on the blank being formed. The sensing elements direct the longitudinal position of the feed rolls and pinch rolls relative to the bending roll and direct the adjustment of the bending roll relative to the feed rolls and pinch rolls as the blank progresses between the pinch rolls and the feed rolls.

Figure 3:
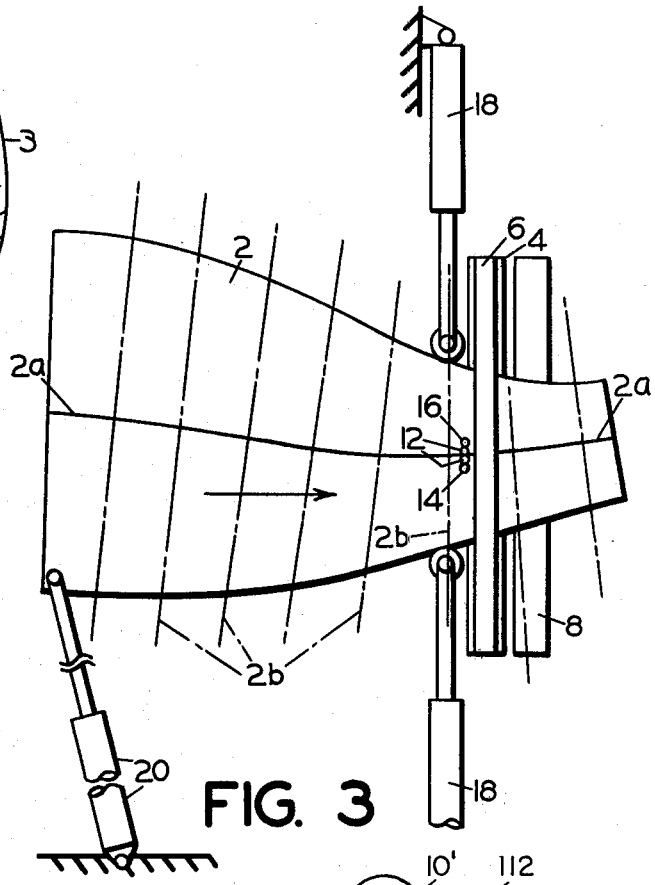
FIG. 3 is a plan view of the apparatus.

In the schematic representation in FIG. 3 the pre-cut blank 2 is provided with a center baseline **2*a* and a plurality of element lines 2*b*. The forming rolls FIG. 4 comprise a drive roll 4, a pinch roll 6 and a bending roll 8 supported on vertical positioning cylinders 10. Positioned above the blank adjacent and parallel to the pinch roll 6 are baseline sensors 12 and element sensors 14 and 16. The baseline sensors 12 function through a computer programmed to maintain the baseline in a fixed longitudinal position relative to the bending roll 8 by directing side cylinders 18 to maintain the established position of the blank 2. The element line sensors 14 and 16 function through the computer to detect the orientation of the element line as the line encounters the feed rolls to maintain the element line parallel to the feed rolls, thereby maintaining the baseline at right angles to the feed rolls This is accomplished by the signals from sensors 14 and 16 causing the computer to accuate the end cylinder 20 to skew the blank 2 to maintain the proper orientation relative to the feed rolls. The passing of the successive element lines by sensors 14 and 16 through the computer directs the bending roll support cylinders 10 to position the bending roll 8** in a vertical direction to provide the proper bending radius at each end of the respective element lines.

An alternate embodiment of the apparatus is shown in FIGS. 6 through 10.

Figures 6, 10:
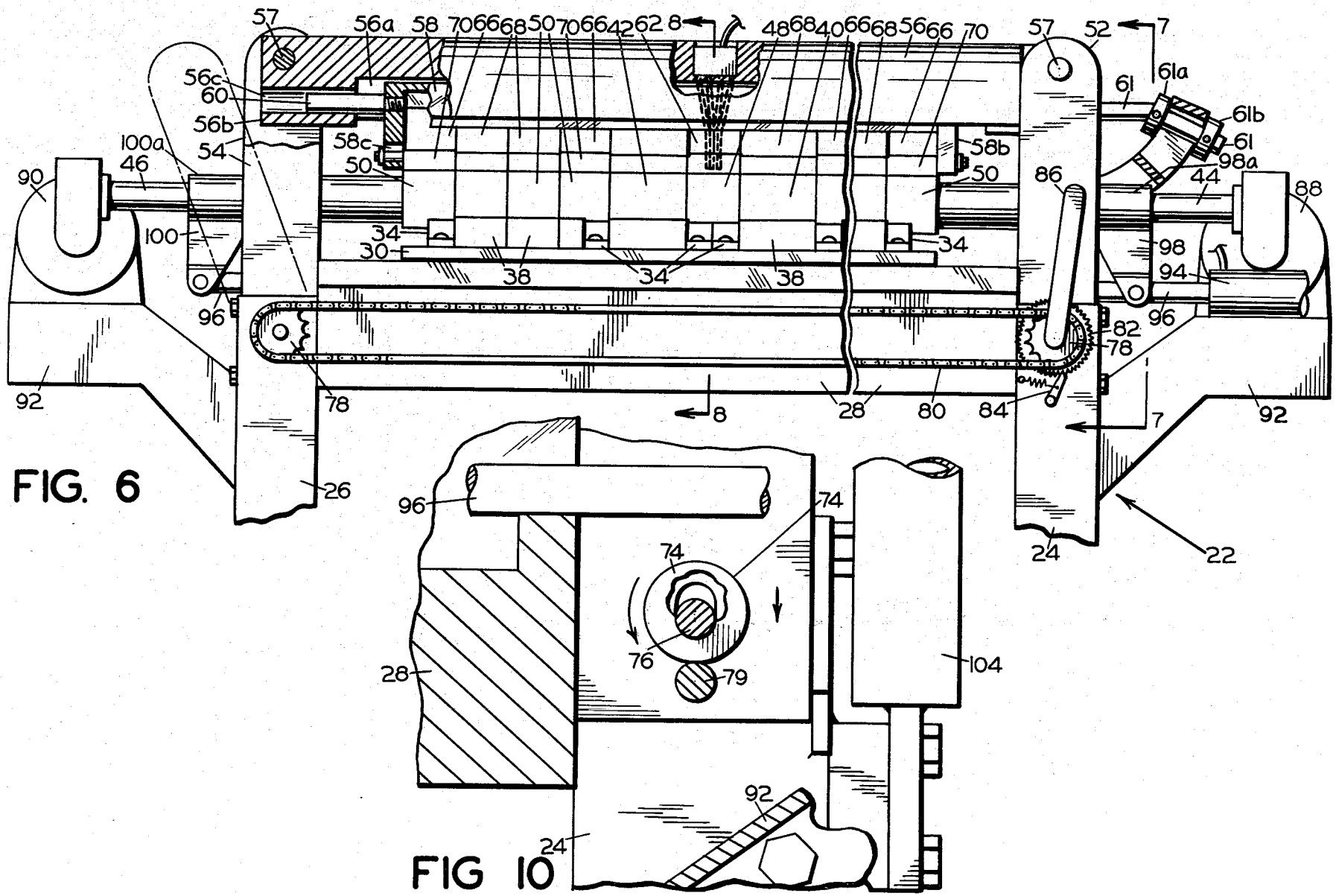
FIG. 6 is a front elevation view of an alternate embodiment of the apparatus.
FIG. 10 is a partial sectional elevation view along the line 10—10 of FIG. 7.

The apparatus FIG. 6 is supported on a frame 22 comprising vertical members 24 and 26 and horizontal member 28. The horizontal frame member 28 is provided at its upper surface, FIG. 8, with a longitudinal "v" groove **28*a*. Positioned within the groove 28*a* is a base member 30 provided with longitudinal grooves 30*a* into which a plurality of bearing balls 32 are placed permitting the base 30 to move longitudinally within the "v" groove 28*a*. Support on the base 30 by a plurality of brackets 34 is a pair of shafts 36 rotatably supporting a plurality of individual backup rolls 38, FIGS. 8 and 9**.

Supported by the backup rolls 38 are feed rolls 40 and 42. The innermost end of the feed rolls 40 and 42 are directly connected to drive shafts 44 and 46. The shafts 44 and 46 each extend beyond their respective feed rolls 40 and 42 providing support for alignment ball bearings 48 FIG. 9. The ball bearings 48 comprise two separate inner bearing races 48*a* and 48*b* to engage the extension of shafts 44 and 46 and a common outer race 48*c*. The outer race 48*c* is slightly crowned at its center to project above the surface of the feed rolls 40 and 42. The bearings 48 provide for independent rotation of the feed rolls 40 and 42 and provide axial separation of the feed rolls. Surrounding the shafts 44 and 46 is a plurality of rotatable idle rollers 50 corresponding in length with the respective plurality of backup rolls 38.

Figure 7:
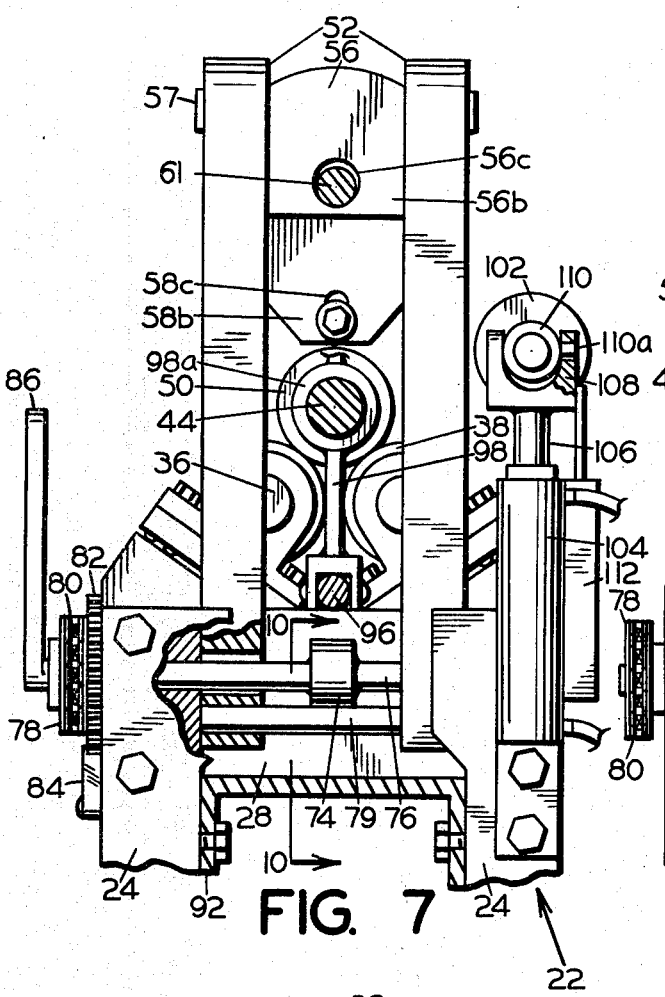
FIG. 7 is a fragmented sectional elevation view along the line 7—7 of FIG. 6.
Figure 8:
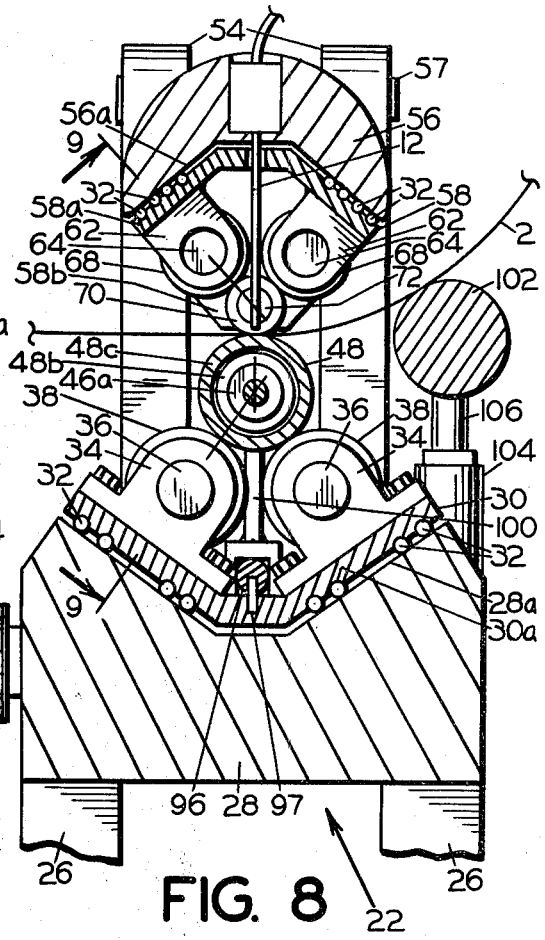
FIG. 8 is a sectional elevation view along the line 8—8 of FIG. 6.

Slidably mounted on the vertical frame members 24 and 26 are pinch roll frame supports 52 and 54 FIGS. 6 and 7. Pinch roll frame 56 is supported on the support members 52 and 54 by pins 57. The frame 56 is provided with an inverted "v" longitudinal channel 56*a* throughout its central section and terminating at the ends in lugs 56*b* having holes 56*c*. A pinch roll carrier 58 having a contour corresponding to the inverted "v" 56*a* is supported in the inverted "v" 56*a* by means of pins 60, 61 engaging the holes 56*c* in the lugs 56*b*. The pinch roll carrier 58 is provided with longitudinal grooves 58*a* into which a plurality of bearing balls 32 are positioned to take the upward thrust of the pinch roll. The pinch roll carrier 58 is provided at its ends with downward extending brackets 58*b* containing an elongated hole 58*c* FIG. 9. Mounted on the pinch roll carrier 58 at its center are a pair of brackets 62 (FIG. 8) having a pair of parallel holes to support backup roll shafts 64. Additional brackets 66 mounted on the pinch roll carrier 58 provide additional support for the backup roll shafts 64. Rotatably mounted on the backup roll shafts 64 is a plurality of backup rolls 68. The pinch rolls 70 are rotatably supported on shaft 72 which is loosely supported in the elongated hole 58*c* in pinch roll carrier 58 permitting the pinch rolls to contact backup rolls 68 when pressure is applied to the pinch rolls. The individual pinch rolls 70 correspond in length with the individual backup rolls 68.

Pinch pressure between the feed rolls 40 and 42 and their corresponding idler rolls 50 and the pinch rolls 70 is provided by vertical positioning of the pinch roll frame supports 52 and 54 by action of cams 74, FIGS. 7 and 10, mounted on cam shafts 76 extending through vertical frame members 24 and 26 and terminating in sprockets 78. The cam 74 engages bar 79 at the lower end of the pinch roll support frames thereby providing downward pressure on the pinch rolls. The sprockets 78 located at the frames 24 and 26 are connected by a chain 80, FIG. 6. A ratchet wheel 82 is engaged by a pawl 84 to lock the shafts 76 in a fixed position. Rotation of the cam shafts 76 is accomplished by means of the lever 86 providing for adjustment of the pinch rolls pressure.

The feed rolls 40 and 42 are driven by independent variable-speed motors 88 and 90 through shafts 44 and 46. The drive motors are mounted on brackets 92 extending from their respective frame members. Mounted on the bracket for motor 88 is a fluid cylinder 94 having a piston rod 96 extending the length of frame member 28 and beyond frame members 26. Connected to the piston rod 96 are positioning brackets 98 and 100 provided with bearings 98*a* and 100*a* surrounding the feed roll shafts 44 and 46 and engaging the outboard idler roll 50 of each of the feed roll shafts. The spacing of the positioning brackets 98 and 100 is established to maintain axial pressure on the bearings 48 maintaining feed rolls 40 and 42 in longitudinal position. The piston rod 96 is attached to feed roll base 30 by pins 97, FIG. 8. Bracket 98 has an upward arcuate extension having an open loop. Pin 61 extends through the loop with retention collars 61*a* and 61*b* providing attachment of bracket 98 to pinch roll carrier 58. The loop in bracket extension 98*a* permits the frame 56 to pivot about pin 57. Actuation of the cylinder 94 and the piston rod 96 causes axial displacement of the feed roll base, the feed rolls and pinch rolls carrier.

The bending roll 102, designated 8 in the first embodiment, is mounted spaced from and parallel to the feed rolls in the horizontal plane on fixed cylinders 104, designated 10 in the first embodiment, having piston rods 106. The upper end of the piston rods are provided with a yoke 108 into which a bearing 110 is pivotally mounted by means of trunnions 110*a* providing for independent elevation of each end of the bending roll. A position indicator 112 is connected with each of the piston rods 106 to indicate the vertical position of the bending roll 102 bearing at each end of the bending roll.

Figure 9:
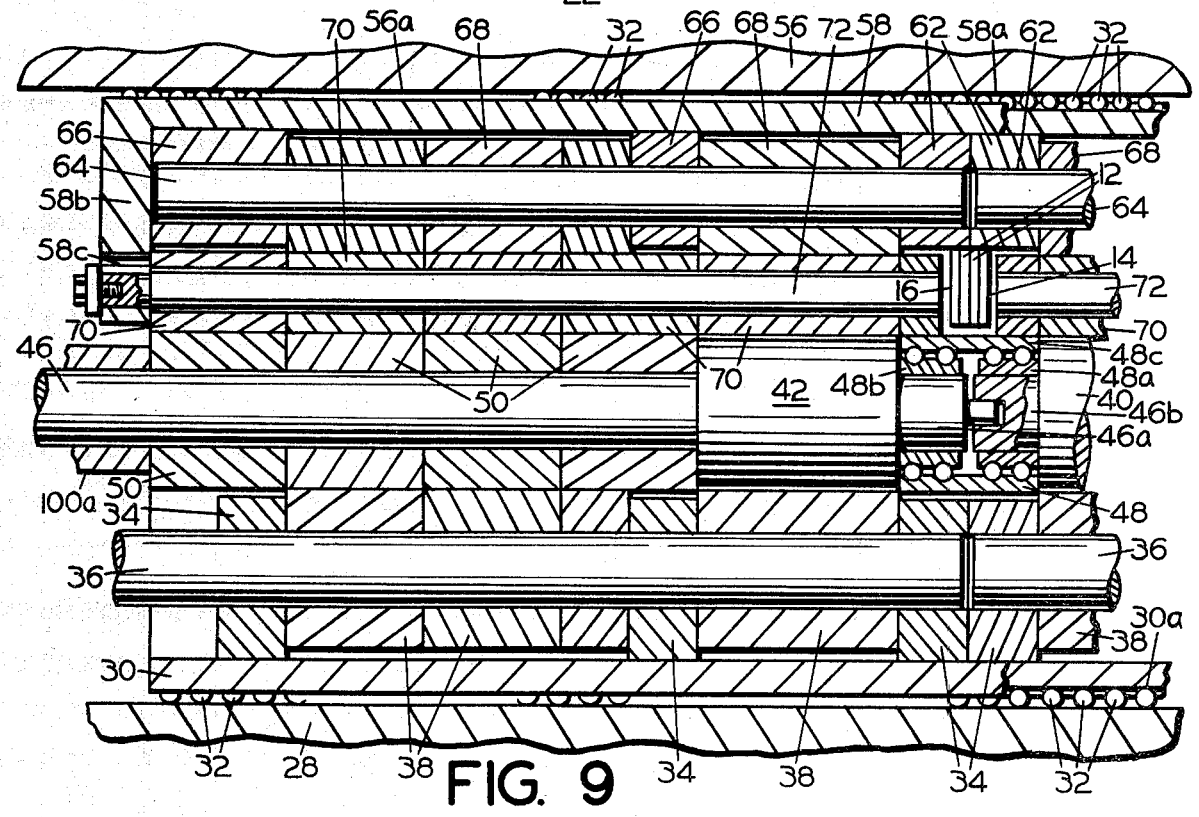
FIG. 9 is a sectional elevation view along the line 9—9 of FIG. 8.

Mounted on the pinch roll frame 56 are baseline sensors 12 and element line sensors 14 and 16 FIG. 9, positioned on the center line of the pinch roller shafts 72 and extending into the space between the ends of the respective pinch roll shafts. The sensors provide signals to the computer programmer FIG. 5 to function as explained under "Operation".

OPERATION

Figure 4:
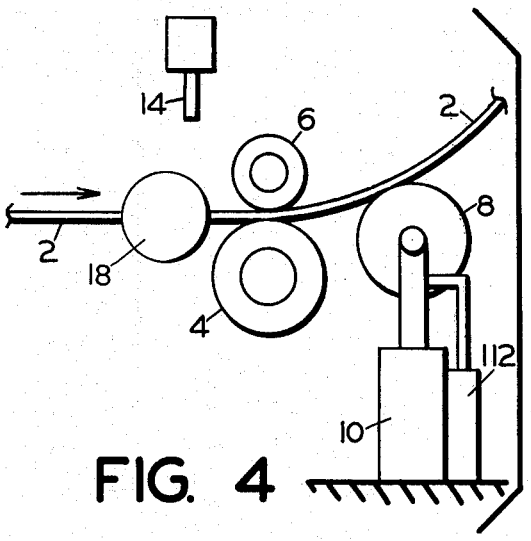
FIG. 4 is an end view of the apparatus of FIG. 3.
Figure 5:
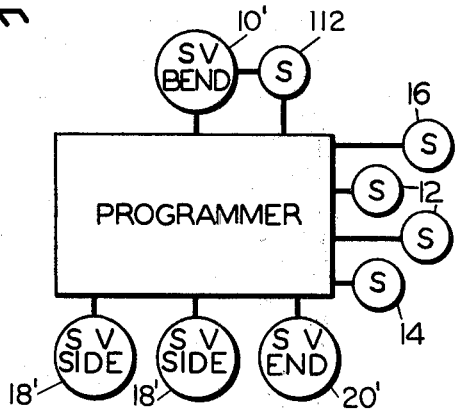
FIG. 5 is a block diagram of the electronic programer and control equipment.

The operation of the embodiments of FIGS. 3 and 4 is as follows:

The pinch roll 6 is adjusted for the thickness of the blank 2 to maintain pressure contact between the blank and drive roll 4. The programmer FIG. 5 is programmed for the configuration being formed. When the apparatus is energized the programmer directs adjustment of the cylinders 10 by actuating solenoid valve 10' to position the bending roll 8 to form the designated radius. The precut blank 2, having a baseline 2*a* and element lines 2*b* thereon, is placed between the pinch roll 6 and drive roll 4 with the baseline between sensors 12. The end cylinder 20 is attached to the trailing end of blank 2.

Drive power is applied to the drive roll 4 causing the blank 2 to move through the rolls contacting bending roll 8. Information from baseline sensors 12 to the programmer actuates the solenoid valves 18' of cylinders 18 to contact the blank 2 and maintain the baseline at the designated position between sensors 12.

As each element line 2*b* arrives at element sensors 14 and 16, information to the programmer causes activation of solenoid valve 20' of the cylinder 20 to skew the blank 2 to maintain the element line parallel with the pinch roll and drive roll. Passage of the successive element lines provides information to the progrmmer to maintain the position of bending roll 8 to form the proper radius to form the duct 3, FIG. 2.

In the event the baseline 2*a* shifts from its designated position between the baseline sensors 12, the sensors 12 send a signal through the programmer that actuates solenoid valves 18' and initiates fluid power to the cylinder 18 to return the baseline to the original position relative to the longitudinal axis of the frame 28 and the bending roll 8, maintaining the established curvature of each edge of the blank.

Figure 1:
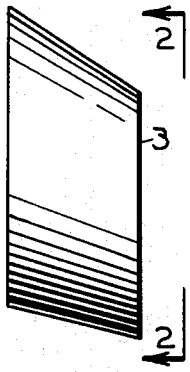
FIG. 1 is a plan view of the duct configuration to be formed.
Figure 2:
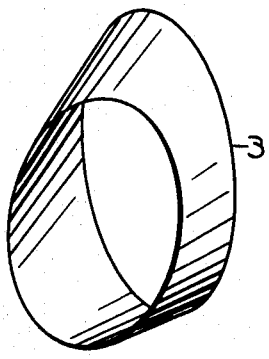
FIG. 2 is an isometric view of the formed duct along the line 2—2 of FIG. 1.

The sequence of events described continues until the entire blank passes between the pinch rolls and the feed rolls forming the duct 3 in FIG. 2. The finished duct 3 is then removed from the rolls by operation of mechanism illustrated in FIG. 6; namely, by removal of pin 57 attaching the pinch roll support 54 to pinch roll frame 56 permitting the support 54 to be swung as indicated by broken lines and frame 56 to pivot on right end pin 57, providing for the formed duct to be removed from the end of the rolls.

Having thus described the apparatus of my invention in preferred embodiments, I claim:

1. Apparatus for forming sheet metal ducts of variable conical configuration from a pre-cut blank having a marked baseline and marked element lines thereon comprising:

(a) a frame supporting
  (1) power-driven feed rolls,
  (2) pinch rolls adapted to pinch the blank against the feed rolls,
  (3) a bending roll rotatably supported in spaced relation to the feed rolls,
(b) means for maintaining the baseline of the blank at its established position relative to the frame, and
(c) means for maintaining the successive element lines of the blank parallel to the axis of the feed rolls.

2. The apparatus of claim 1 wherein the means for maintaining the baseline of the blank at its established position relative to the frame includes means for detecting a shift in the baseline position and means for shifting the feed rolls axially relative to the frame.

3. The apparatus of claim 2 including a fluid-actuated cylinder for shifting the feed rolls axially relative to the frame.

4. The apparatus of claim 1 wherein the feed rolls and the pinch rolls comprise axially aligned independent rolls separated at the center.

5. The apparatus of claim 4 wherein the means for maintaining the successive element lines of the blank parallel to the axis of the feed rolls includes sensing means to determine the angle of the element line to the feed rolls and means to alter the speed of one of the feed rolls relative to the other causing the blank to skew about the baseline at the center of feed rolls.

6. The apparatus of claim 1 including means for independently positioning the ends of the bending roll relative to the axis of the feed rolls to affect the desired bending curvature at each edge of the blank.

7. The apparatus of claim 6 wherein the means for positioning the ends of the bending roll includes fluid-actuated cylinders.

8. The apparatus of claim 7 including position indicators to establish the position of the ends of the bending roll.

9. The apparatus of claim 1 wherein the feed rolls comprise a shaft-driven roll and a plurality of idler rolls.

10. Apparatus for forming sheet metal ducts of variable conical configuration from a pre-cut blank having a marked baseline and marked element lines thereon comprising:

(a) a frame supporting
  (1) axially aligned independent feed rolls having independent variable-speed drives attached thereto,
  (2) axially aligned independent pinch rolls juxtaposed and parallel to the feed rolls,
  (3) a bending roll spaced from the feed roll and rotatably supported on indepenent fluid cylinders providing angular setting of the bending roll relative to the feed rolls
(b) frame-mounted sensor means positioned between the end of the independent pinch rolls for sensing the position of the baseline and the angularity of the element lines relative to the feed rolls,
(c) fluid cylinder means for axially displacing the feed and pinch rolls relative to the sensors to maintain the baseline position at the sensors,
(d) control means for varying the speed of the feed roll drives relative to the angularity of the element lines as detected by the element sensors to maintain the element lines parallel to the feed rolls, and
(e) rotatable cams for adjusting the pressure between the pinch rolls and the feed rolls to maintain feed pressure on the blank.

* * * * *